US010895059B2

(12) United States Patent
Misaki

(10) Patent No.: US 10,895,059 B2
(45) Date of Patent: Jan. 19, 2021

(54) SHOVEL

(71) Applicant: SUMITOMO(S.H.I.) CONSTRUCTION MACHINERY CO., LTD., Tokyo (JP)

(72) Inventor: Youji Misaki, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/558,736

(22) Filed: Sep. 3, 2019

(65) Prior Publication Data

US 2019/0390434 A1 Dec. 26, 2019

Related U.S. Application Data

(63) Continuation of application No. PCT/JP2018/009218, filed on Mar. 9, 2018.

(30) Foreign Application Priority Data

Mar. 10, 2017 (JP) ..... 2017-046770

(51) Int. Cl.

| | |
|---|---|
| ***E02F 3/32*** | (2006.01) |
| ***E02F 3/42*** | (2006.01) |
| ***E02F 9/22*** | (2006.01) |

(52) U.S. Cl.

CPC ..... *E02F 3/425* (2013.01); *E02F 3/32* (2013.01); *E02F 9/2228* (2013.01); (Continued)

(58) Field of Classification Search

CPC ..... E02F 9/2296; E02F 9/2292; E02F 3/32; E02F 9/2228; E02F 9/2285; E02F 3/425

See application file for complete search history.

(56) References Cited

U.S. PATENT DOCUMENTS

| | | | | |
|---|---|---|---|---|
| 5,394,697 | A * | 3/1995 | Hirata | E02F 9/2235 60/426 |
| 6,308,516 | B1 | 10/2001 | Kamada | |
| 9,903,097 | B2 * | 2/2018 | Hashimoto | F15B 11/16 |

FOREIGN PATENT DOCUMENTS

| | | |
|---|---|---|
| EP | 2775150 | 9/2014 |
| JP | H10-018359 | 1/1998 |

(Continued)

OTHER PUBLICATIONS

International Search Report for PCT/JP2018/009218 dated Jun. 5, 2018.

(Continued)

*Primary Examiner* — Abiy Teka

(74) *Attorney, Agent, or Firm* — IPUSA, PLLC

(57) ABSTRACT

A shovel includes a lower traveling body, an upper turning body turnably mounted on the lower traveling body, a hydraulic pump mounted on the upper turning body, a hydraulic actuator configured to be driven with hydraulic oil discharged by the hydraulic pump, a bleed valve configured to control the flow rate of a portion of the hydraulic oil discharged by the hydraulic pump, the portion flowing to a hydraulic oil tank without going through the hydraulic actuator, and a control device configured to control the opening area of the bleed valve in accordance with the magnitude of pulsation in the pressure of hydraulic oil supplied from the hydraulic pump to the hydraulic actuator.

22 Claims, 7 Drawing Sheets

(52) U.S. Cl.
CPC ..... *E02F 9/2285* (2013.01); *E02F 9/2292* (2013.01); *E02F 9/2296* (2013.01)

(56) References Cited

FOREIGN PATENT DOCUMENTS

| | | |
|---|---|---|
| JP | H11-081389 | 3/1999 |
| JP | 2000-035005 | 2/2000 |
| JP | 2007-100779 | 4/2007 |
| WO | 1993/018308 | 9/1993 |
| WO | 2008/088044 | 7/2008 |
| WO | 2014/097693 | 6/2014 |

OTHER PUBLICATIONS

Written Opinion of the International Preliminary Examining Authority for PCT/JP2018/009218 dated Apr. 9, 2019.

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/009218, filed on Mar. 9, 2018 and designating the U.S., which claims priority to Japanese patent application No. 2017-046770, filed on Mar. 10, 2017. The entire contents of the foregoing applications are incorporated herein by reference.

BACKGROUND

Technical Field

The present disclosure relates to shovels.

Description of Related Art

A shovel in which the bleed off of directional control valves each corresponding to one of hydraulic actuators sharing a main pump can be controlled with a single cut valve has been known.

According to this shovel, the turning acceleration force of an upper turning body when the working radius of a work attachment is small is controlled by increasing the bleed off as the working radius of the work attachment decreases.

SUMMARY

According to an aspect of the present invention, a shovel includes a lower traveling body, an upper turning body turnably mounted on the lower traveling body, a hydraulic pump mounted on the upper turning body, a hydraulic actuator configured to be driven with hydraulic oil discharged by the hydraulic pump, a bleed valve configured to control the flow rate of a portion of the hydraulic oil discharged by the hydraulic pump, the portion flowing to a hydraulic oil tank without going through the hydraulic actuator, and a control device configured to control the opening area of the bleed valve in accordance with the magnitude of pulsation in the pressure of hydraulic oil supplied from the hydraulic pump to the hydraulic actuator.

DETAILED DESCRIPTION

The above-described shovel, however, only controls the bleed off with the cut valve to stabilize turning operability, and does not use the cut valve to control the pulsation of the pressure of hydraulic oil within a hydraulic circuit. Therefore, the pulsation of the pressure of hydraulic oil within the hydraulic circuit cannot be controlled.

According to an aspect of the present invention, a shovel that can control the pulsation of the pressure of hydraulic oil within a hydraulic circuit is provided.

Figure 1:
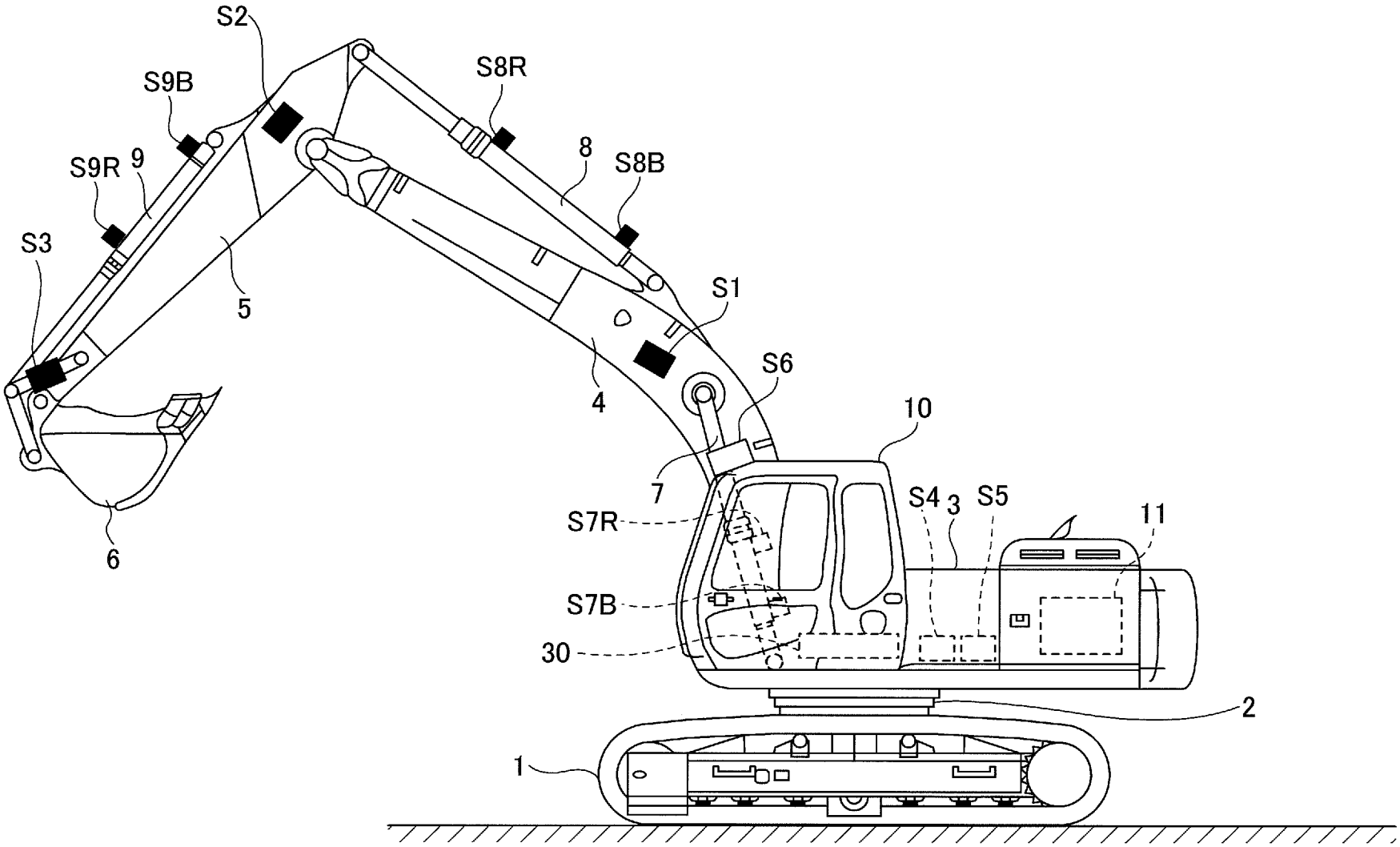
FIG. 1 is a side view of a shovel according to an embodiment of the present invention.

FIG. 1 is a side view of a shovel (excavator) according to an embodiment of the present invention. According to the shovel, an upper turning body 3 is turnably mounted on a lower traveling body 1 through a turning mechanism 2. A boom 4 is attached to the upper turning body 3. An arm 5 is attached to the end of the boom 4. A bucket 6 serving as an end attachment is attached to the end of the arm 5.

The boom 4, the arm 5, and the bucket 6 constitute an excavation attachment that is an example of an attachment, and are hydraulically driven by a boom, cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6.

The boom angle sensor S1 detects the rotation angle of the boom 4. According to this embodiment, the boom angle sensor S1 is an acceleration sensor and can detect the rotation angle of the boom 4 relative to the upper turning body 3 (hereinafter referred to as "boom angle $\alpha$"). The boom angle $\alpha$ is zero degrees when the boom 4 is lowest and increases as the boom 4 is raised, for example.

The arm angle sensor S2 detects the rotation angle of the arm 5. According to this embodiment, the arm angle sensor S2 is an acceleration sensor and can detect the rotation angle of the arm 5 relative to the boom 4 (hereinafter referred to as "arm angle $\beta$"). The arm angle $\beta$ is zero degrees when the arm 5 is most closed and increases as the arm 5 is opened, for example.

The bucket angle sensor S3 detects the rotation angle of the bucket 6. According to this embodiment, the bucket angle sensor S3 is an acceleration sensor and can detect the rotation angle of the bucket 6 relative to the arm 5 (hereinafter referred to as "bucket angle $\gamma$"). The bucket angle $\gamma$ is zero degrees when the bucket 6 is most closed and increases as the bucket 6 is opened, for example.

Each of the boom angle sensor S1, the arm angle sensor S2, and the bucket angle sensor S3 may alternatively be a potentiometer using a variable resistor, a stroke sensor that detects the stroke amount of a corresponding hydraulic cylinder, a rotary encoder that detects a rotation angle about a link pin, a gyro sensor, a combination of an acceleration sensor and a gyro sensor, or the like.

A boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9.

The boom rod pressure sensor S7R detects the pressure of the rod-side oil chamber of the boom cylinder 7 (hereinafter, "boom rod pressure"), and the boom bottom pressure sensor S7B detects the pressure of the bottom-side oil chamber of the boom cylinder 7 (hereinafter, "boom bottom pressure"). The arm rod pressure sensor S8R detects the pressure of the rod-side oil chamber of the arm cylinder 8 (hereinafter, "arm rod pressure"), and the arm bottom pressure sensor S8B detects the pressure of the bottom-side oil chamber of the arm cylinder 8 (hereinafter, "arm bottom pressure"). The bucket rod pressure sensor S9R detects the pressure of the rod-side oil chamber of the bucket cylinder 9 (hereinafter, "bucket rod pressure"), and the bucket bottom pressure sensor S9B detects the pressure of the bottom-side oil chamber of the bucket cylinder 9 (hereinafter, "bucket bottom pressure").

A cabin 10 that is a cab is provided and a power source such as an engine 11 is mounted on the upper turning body 3. A body tilt sensor S4, a turning angular velocity sensor S5, and a camera S6 are attached to the upper turning body 3.

The body tilt sensor S4 detects the tilt of the upper turning body 3 relative to a horizontal plane. According to this embodiment, the body tilt sensor S4 is an acceleration sensor that detects the tilt angle of the upper turning body 3 about its longitudinal axis and lateral axis. The longitudinal axis and lateral axis of the upper turning body 3 are orthogonal to each other and pass through the center point of the shovel that is a point on the turning axis of the shovel, for example.

The turning angular velocity sensor S5 detects the turning angular velocity of the upper turning body 3. The turning angular velocity sensor S5 is a gyro sensor according to this embodiment, but may alternatively be a resolver, a rotary encoder, or the like.

The camera S6 obtains an image of an area surrounding the shovel. According to this embodiment, the camera S6 includes a front camera attached to the upper turning body 3. The front camera is a stereo camera that captures an image of an area in front of the shovel. The front camera is attached to the roof of the cabin 10, namely, the exterior of the cabin 10, but may alternatively be attached to the ceiling of the cabin 10, namely, the interior of the cabin 10. The front camera can capture an image of an excavation attachment. The front camera may alternatively be a monocular camera.

A controller 30 is installed in the cabin 10. The controller 30 serves as a main control part that controls the driving of the shovel. According to this embodiment, the controller 30 is composed of a computer including a CPU, a RAM, a ROM, etc. Various functions of the controller 30 are implemented by the CPU executing programs stored in the ROM, for example.

Figure 2:
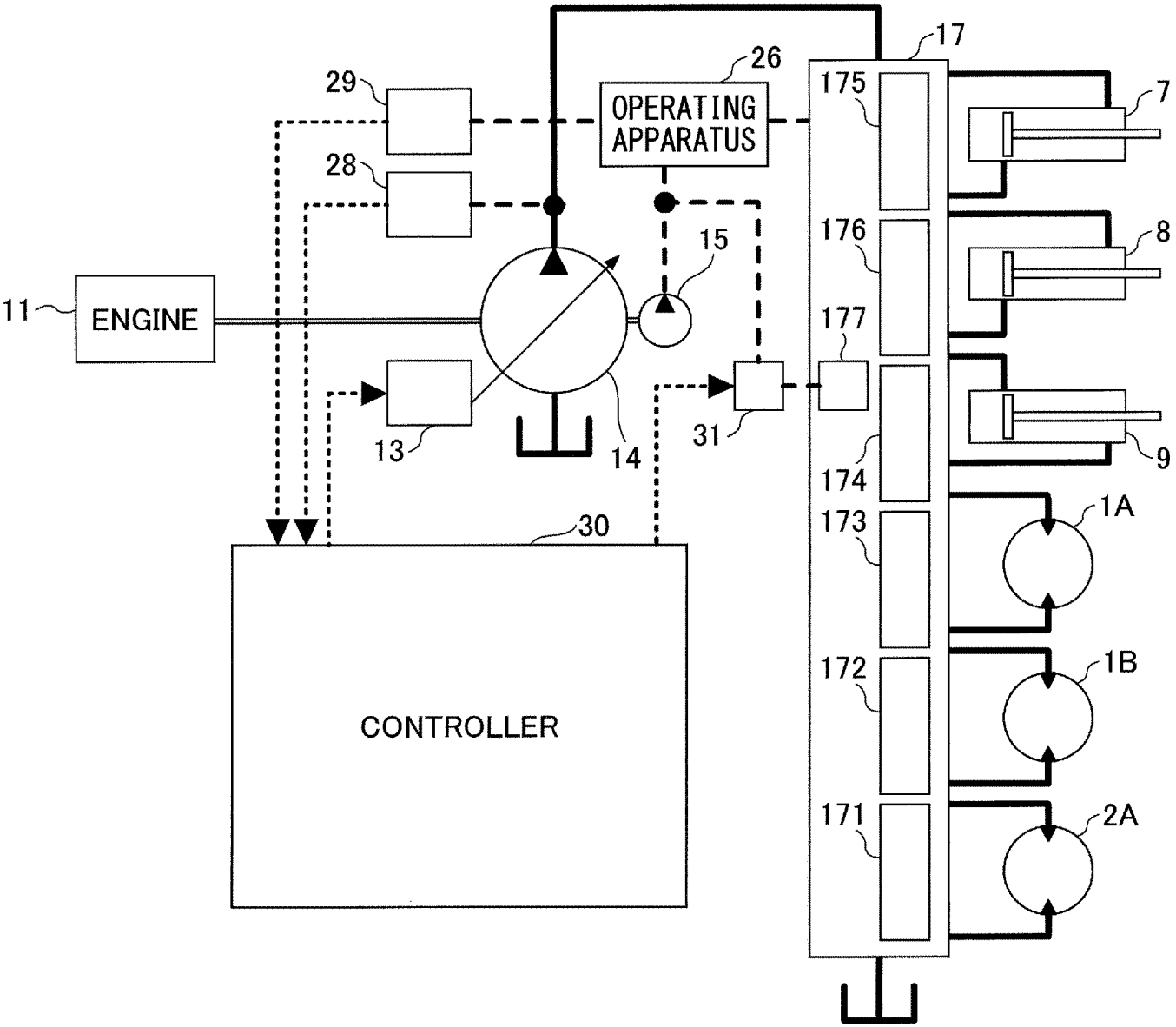
FIG. 2 is a block diagram illustrating an example configuration of the drive system of the shovel of FIG. 1.

FIG. 2 is a block diagram illustrating an example configuration of the drive system of the shovel of FIG. 1, indicating a mechanical power transmission line, a hydraulic oil line, a pilot line, and an electric control line by a double line, a thick solid line, a dashed line, and a dotted line, respectively.

The drive system of the shovel mainly includes the engine 11, a regulator 13, a main pump 14, a pilot pump 15, a control valve 17, an operating apparatus 26, a discharge pressure sensor 28, an operating pressure sensor 29, the controller 30, and a proportional valve 31.

The engine 11 is a drive source of the shovel. According to this embodiment, the engine 11 is, for example, a diesel engine that so operates as to maintain a predetermined rotational speed. The output shaft of the engine 11 is coupled to the input shafts of the main pump 14 and the pilot pump 15.

The main pump 14 supplies hydraulic oil to the control valve 17 via a hydraulic oil line. According to this embodiment, the main pump 14 is a swash plate variable displacement hydraulic pump.

The regulator 13 controls the discharge quantity of the main pump 14. According to this embodiment, the regulator 13 controls the discharge quantity of the main pump 14 by adjusting the tilt angle of the swash plate of the main pump 14 in response to a control command from the controller 30.

The pilot pump 15 supplies hydraulic oil to various hydraulic control apparatuses including the operating apparatus 26 and the proportional valve 31 via a pilot line. According to this embodiment, the pilot pump 15 is a fixed displacement hydraulic pump.

The control valve 17 is a hydraulic controller that controls the hydraulic system of the shovel. The control valve 17 includes control valves 171 through 176 and a bleed valve 177. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to hydraulic actuators and the flow rate of hydraulic oil flowing from hydraulic actuators to a hydraulic oil tank. The hydraulic actuators include the boom cylinder 7, the arm cylinder 8, the bucket cylinder 9, a left side traveling hydraulic motor 1A, a right side traveling hydraulic motor 1B, and a turning hydraulic motor 2A. The bleed valve 177 controls the flow rate of a portion of the hydraulic oil discharged by the main pump 14 which flows to the hydraulic oil tank through no hydraulic actuators (hereinafter, "bleed flow rate"). The bleed valve 177 may be installed outside the control valve 17.

The operating apparatus 26 is an apparatus that an operator uses to operate hydraulic actuators. According to this embodiment, the operating apparatus 26 supplies hydraulic oil discharged by the pilot pump 15 to the pilot ports of control valves corresponding to hydraulic actuators through a pilot line. The pressure of hydraulic oil supplied to each pilot port (pilot pressure) is a pressure commensurate with the direction of operation and the amount of operation of a lever or pedal (not depicted) of the operating apparatus 26 for a corresponding hydraulic actuator.

The discharge pressure sensor 28 detects the discharge pressure of the main pump 14. According to this embodiment, the discharge pressure sensor 28 outputs the detected value to the controller 30.

The operating pressure sensor 29 detects the details of the operator's operation using the operating apparatus 26. According to this embodiment, the operating pressure sensor 29 detects the direction of operation and the amount of operation of a lever or pedal of the operating apparatus 26 for a corresponding hydraulic actuator in the form of pressure, and outputs the detected value to the controller 30. The details of the operation of the operating apparatus 26 may be detected using a sensor other than an operating pressure sensor.

The proportional valve 31 operates in response to a control command output by the controller 30. According to this embodiment, the proportional valve 31 is a solenoid valve that adjusts a secondary pressure introduced from the pilot pump 15 to the pilot port of the bleed valve 177 in the control valve 17, in response to an electric current command output by the controller 30. For example, the proportional valve 31 operates such that the secondary pressure introduced to the pilot port of the bleed valve 177 increases as the electric current command increases.

Figure 3:
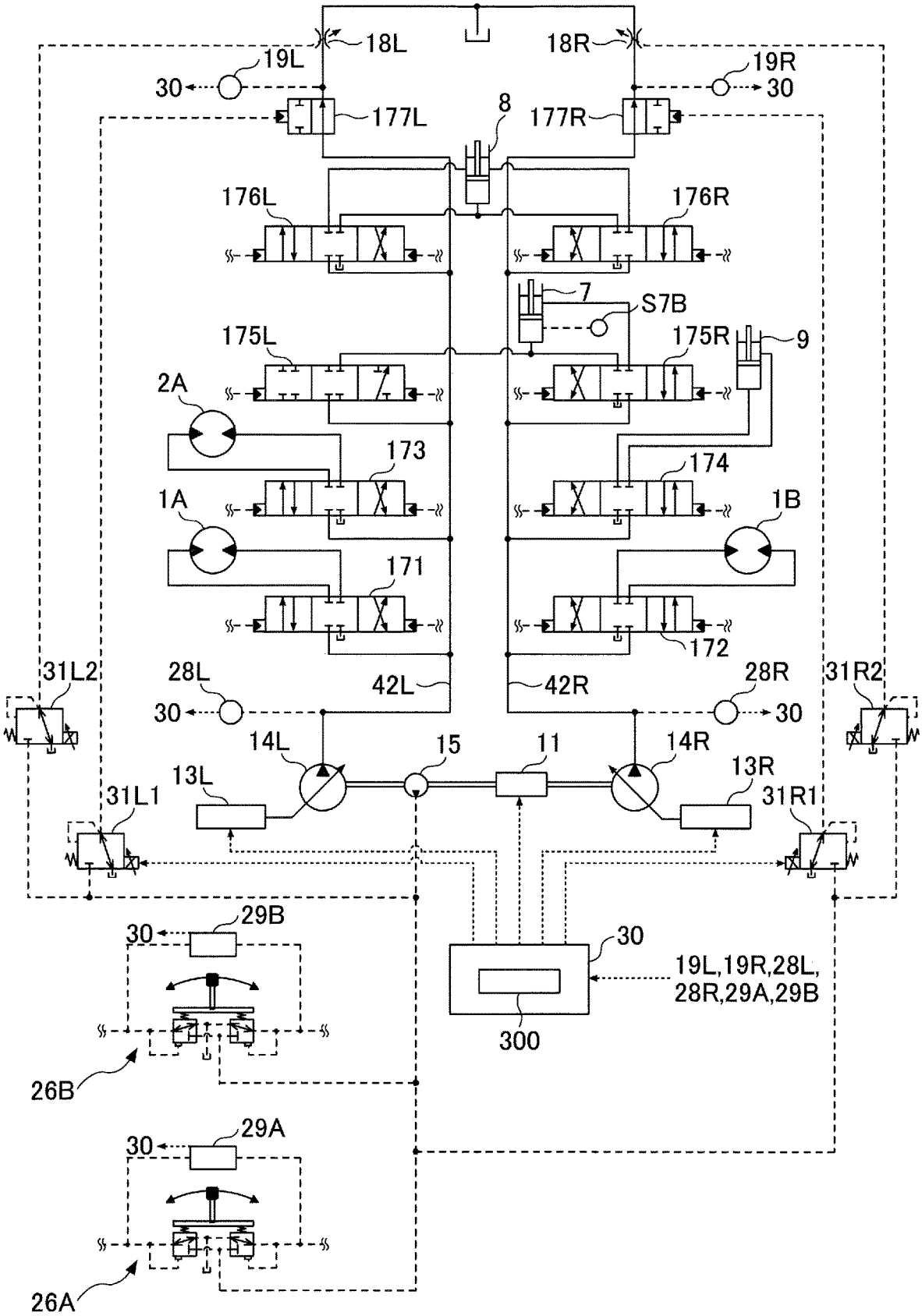
FIG. 3 is a schematic diagram illustrating an example configuration of a hydraulic circuit installed in the shovel of FIG. 1.

Next, an example configuration of a hydraulic circuit installed in the shovel is described with reference to FIG. 3. FIG. 3 is a schematic diagram illustrating an example configuration of a hydraulic circuit installed in the shovel of FIG. 1. Like FIG. 2, FIG. 3 indicates a mechanical power transmission line, a hydraulic oil line, a pilot line, and an electric control line by a double line, a thick solid line, a dashed line, and a dotted line, respectively.

The hydraulic circuit of FIG. 3 circulates hydraulic oil from main pumps 14L and 14R driven by the engine 11 to the hydraulic oil tank via conduits 42L and 42R. The main pumps 14L and 14R correspond to the main pump 14 of FIG. 2.

The conduit 42L is a hydraulic oil line that connects the control valves 171 and 173 and control valves 175L and 176L placed in the control valve 17 in parallel between the main pump 14L and the hydraulic oil tank. The conduit 42R is a hydraulic oil line that connects the control valves 172 and 174 and control valves 175R and 176R placed in the control valve 17 in parallel between the main pump 14R and the hydraulic oil tank.

The control valve 171 is a spool valve that switches the flow of hydraulic oil in order to supply hydraulic oil discharged by the main pump 14L to the left side traveling hydraulic motor 1A and to discharge hydraulic oil discharged by the left side traveling hydraulic motor 1A to the hydraulic oil tank.

The control valve 172 is a spool valve that switches the flow of hydraulic oil in order to supply hydraulic oil discharged by the main pump 14R to the right side traveling hydraulic motor 1B and to discharge hydraulic oil discharged by the right side traveling hydraulic motor 1B to the hydraulic oil tank.

The control valve 173 is a spool valve that switches the flow of hydraulic oil in order to supply hydraulic oil discharged by the main pump 14L to the turning hydraulic motor 2A and to discharge hydraulic oil discharged by the turning hydraulic motor 2A to the hydraulic oil tank.

The control valve 174 is a spool valve for supplying hydraulic oil discharged by the main pump 14R to the bucket cylinder 9 and to discharge hydraulic oil in the bucket cylinder 9 to the hydraulic oil tank.

The control valves 175L and 175R are spool valves that switch the flow of hydraulic oil in order to supply hydraulic oil discharged by the main pumps 14L and 14R to the boom cylinder 7 and to discharge hydraulic oil in the boom cylinder 7 to the hydraulic oil tank.

The control valves 176L and 176R are spool valves that switch the flow of hydraulic oil in order to supply hydraulic oil discharged by the main pumps 14L and 14R to the arm cylinder 8 and to discharge hydraulic oil in the arm cylinder 8 to the hydraulic oil tank.

A bleed valve 177L is a spool valve that controls the bleed flow rate with respect to hydraulic oil discharged by the main pump 14L. A bleed valve 177R is a spool valve that controls the bleed flow rate with respect to hydraulic oil discharged by the main pump 14R. The bleed valves 177L and 177R correspond to the bleed valve 177 of FIG. 2.

The bleed valves 177L and 177R have a first valve position of a minimum opening area (an opening degree of 0%) and a second valve position of a maximum opening area (an opening degree of 100%). The bleed valves 177L and 177R can steplessly move between the first valve position and the second valve position.

Regulators 13L and 13R control the discharge quantity of the main pumps 14L and 14R by adjusting the swash plate tilt angle of the main pumps 14L and 14R. The regulators 13L and 13R correspond to the regulator 13 of FIG. 2. For example, the controller 30 reduces the discharge quantity by adjusting the swash plate tilt angle of the main pumps 14L and 14R with the regulators 13L and 13R in response to an increase in the discharge pressure of the main pumps 14L and 14R. This is for preventing the absorbed power of the main pump 14 expressed by the product of the discharge pressure and the discharge quantity from exceeding the output power of the engine 11.

An arm operating lever 26A, which is an example of the operating apparatus 26, is used to operate the arm 5. The arm operating lever 26A uses hydraulic oil discharged by the pilot pump 15 to introduce a control pressure commensurate with the amount of lever operation to pilot ports of the control valves 176L and 176R. Specifically, when operated in an arm closing direction, the arm operating lever 26A introduces hydraulic oil to the right side pilot port of the control valve 176L and introduces hydraulic oil to the left side pilot port of the control valve 176R. Furthermore, when operated in an arm opening direction, the arm operating lever 26A introduces hydraulic oil to the left side pilot port of the control valve 176L and introduces hydraulic oil to the right side pilot port of the control valve 176R.

A boom operating lever 26B, which is an example of the operating apparatus 26, is used to operate the boom 4. The boom operating lever 26B uses hydraulic oil discharged by the pilot pump 15 to introduce a control pressure commensurate with the amount of lever operation to pilot ports of the control valve 175L and 175R. Specifically, when operated in a boom raising direction, the boom operating lever 26B introduces hydraulic oil to the right side pilot port of the control valve 175L and introduces hydraulic oil to the left side pilot port of the control valve 175R. Furthermore, when operated in a boom lowering direction, the boom operating lever 26B introduces hydraulic oil to the left side pilot port of the control valve 175L and introduces hydraulic oil to the right side pilot port of the control valve 175R.

Discharge pressure sensors 28L and 28R, which are examples of the discharge pressure sensor 28, detect the discharge pressure of the main pumps 14L and 14R, and output the detected value to the controller 30.

Operating pressure sensors 29A and 29B, which are examples of the operating pressure sensor 29, detect the details of the operator's operation on the arm operating lever 26A and the boom operating lever 26B in the form of pressure, and output the detected value to the controller 30. Examples of the details of operation include the direction of lever operation and the amount of lever operation (the angle of lever operation).

Right and left traveling levers (or pedals), a bucket operating lever, and a turning operating lever (none of which is depicted) are operating apparatuses for performing operations for causing the lower traveling body 1 to travel, opening and closing the bucket 6, and turning the upper turning body 3, respectively. Like the arm operating lever 26A and the boom operating lever 26B, these operating apparatuses each introduce a control pressure commensurate with the amount of lever operation (or the amount of pedal operation) to the right or left pilot port of a control valve for a corresponding hydraulic actuator, using hydraulic oil discharged by the pilot pump 15. The details of the operator's operation on each of these operating apparatuses are detected in the form of pressure by a corresponding operating pressure sensor like the operating pressure sensors 29A and 29B, and the detected value is output to the controller 30.

The controller 30 receives the outputs of the operating pressure sensors 29A and 29B, etc., and outputs a control command to the regulators 13L and 13R to change the discharge quantity of the main pump 14L and 14R on an as-needed basis. Furthermore, the controller 30 outputs an electric current command to proportional valves 31L1, 31L2, 31R1, and 31R2 to change the opening area of the bleed valves 177L and 177R and negative control throttles 18L and 18R (hereinafter, "NEG control throttles 18L and 18R") on an as-needed basis.

The proportional valves 31L1 and 31R1 adjust a secondary pressure introduced from the pilot pump 15 to the pilot ports of the bleed valves 177L and 177R in accordance with an electric current command output by the controller 30. The proportional valves 31L2 and 31R2 adjust a secondary pressure introduced from the pilot pump 15 to the NEG control throttles 18L and 18R in accordance with an electric current command output by the controller 30. The proportional valves 31L1, 31L2, 31R1, and 31R2 correspond to the proportional valve 31 of FIG. 2.

The proportional valve 31L1 can adjust the secondary pressure so that the bleed valve 177L can stop at any position between the first valve position and the second valve position. The proportional valve 31R1 can adjust the secondary pressure so that the bleed valve 177R can stop at any position between the first valve position and the second valve position.

The proportional valve 31L2 can adjust the secondary pressure so that the opening area of the NEG control throttle 18L can be adjusted. The proportional valve 31R2 can adjust the secondary pressure so that the opening area of the NEG control throttle 18R can be adjusted.

Here, negative control (hereinafter referred to as "NEG control") adopted in the hydraulic circuit of FIG. 3 is described.

In the conduits 42L and 42R, the NEG control throttles 18L and 18R are placed between the most downstream bleed valves 177L and 177R and the hydraulic oil tank. The flow of hydraulic oil to the hydraulic oil tank through the bleed valves 177L and 177R is restricted by the NEG control throttles 18L and 18R. The NEG control throttles 18L and 18R generate a control pressure for controlling the regulators 13L and 13R (hereinafter referred to as "NEG control pressure"). NEG control pressure sensors 19L and 19R are sensors for detecting the NEG control pressure, and output the detected value to the controller 30.

According to this embodiment, the NEG control throttles 18L and 18R are variable throttles whose opening area varies in accordance with the secondary pressure of the proportional valves 31L2 and 31R2. For example, the opening area of the NEG control throttles 18L and 18R decreases as the secondary pressure of the proportional valves 31L2 and 31R2 increases. Alternatively, the NEG control throttles 18L and 18R may be fixed throttles.

The controller 30 controls the discharge quantity of the main pumps 14L and 14R by adjusting the swash plate tilt angle of the main pumps 14L and 14R in accordance with the NEG control pressure. Hereinafter, the relationship between the NEG control pressure and the discharge quantity of the main pumps 14L and 14R is referred to as "NEG control characteristic." For example, the NEG control characteristic may be stored in the ROM or the like as a reference table or may be expressed by a predetermined calculation formula. For example, the controller 30 refers to a table representing a predetermined NEG control characteristic, and decreases the discharge quantity of the main pumps 14L and 14R as the NEG control pressure increases and increases the discharge quantity of the main pumps 14L and 14R as the NEG control pressure decreases.

Specifically, as illustrated in FIG. 3, in a standby state where none of the hydraulic actuators in the shovel is in operation, hydraulic oil discharged by the main pumps 14L and 14R passes through the bleed valves 177L and 177R to reach the NEG control throttles 18L and 18R. The flow of hydraulic oil passing through the bleed valves 177L and 177R increases the NEG control pressure generated upstream of the negative control throttles 18L and 18R. As a result, the controller 30 decreases the discharge quantity of the main pumps 14L and 14R to a predetermined minimum allowable discharge quantity to control pressure loss (pumping loss) during passage of the discharged hydraulic oil through the conduits 42L and 42R. This predetermined minimum allowable discharge quantity is an example of the bleed flow rate, and is hereinafter referred to as "standby flow rate."

When any of the hydraulic actuators is operated, hydraulic oil discharged by the main pumps 14L and 14R flows into the operated hydraulic actuator through a control valve corresponding to the operated hydraulic actuator. Therefore, the bleed flow rate reaching the negative control throttles 18L and 18R through the bleed valves 177L and 177R decreases, so that the NEG control pressure generated upstream of the NEG control throttles 18L and 18R is reduced. As a result, the controller 30 increases the discharge quantity of the main pumps 14L and 14R to supply sufficient hydraulic oil to the operated hydraulic actuator to ensure driving of the operated hydraulic actuator. Hereinafter, the flow rate of hydraulic oil flowing into a hydraulic actuator is referred to as "actuator flow rate." In this case, the flow rate of hydraulic oil discharged by the main pumps 14L and 14R is equivalent to the sum of the actuator flow rate and the bleed flow rate.

According to the configuration as described above, in the case of actuating a hydraulic actuator, the hydraulic circuit of FIG. 3 can ensure that necessary and sufficient hydraulic oil is supplied from the main pumps 14L and 14R to the hydraulic actuator to be actuated. Furthermore, in the standby state, the hydraulic circuit of FIG. 3 can reduce unnecessary hydraulic energy consumption because the bleed flow rate can be reduced to the standby flow rate.

According to the hydraulic circuit of FIG. 3, however, even in the standby state, hydraulic oil of the standby flow rate is constantly supplied to the NEG control throttles 18L and 18R. Furthermore, when a hydraulic actuator is being actuated, a certain amount of hydraulic oil is constantly supplied to the NEG control throttles 18L and 18R as the bleed flow rate. This is for generating the NEG control pressure and also for making it possible to swiftly change the discharge quantity in accordance with the motion of the hydraulic actuator.

As the bleed flow rate decreases, an effect due to control of unnecessary hydraulic energy consumption increases, but the flow rate of hydraulic oil flowing to a hydraulic actuator is more likely to vary. In this case, when a pressure variation occurs in a vibration system of the hydraulic system, and a flow rate variation is large relative to the pressure variation, a large vibration results. This is because the damping term of a second-order vibration system is expressed by $-\partial Q/\partial P$, where P represents the discharge pressure of the main pump 14 (the load pressure of a hydraulic actuator) and Q represents the flow rate of hydraulic oil flowing into a hydraulic actuator. Therefore, when the pressure variation increases because of an increase in the load, it is desirable to increase the bleed flow rate to reduce the flow rate variation of hydraulic oil flowing into the hydraulic actuator. Accordingly, it is inappropriate to reduce the bleed flow rate without exception.

Therefore, a bleed valve controlling part 300 of the controller 30 achieves both control of unnecessary hydraulic energy consumption and control of pressure pulsation by changing the bleed flow rate in accordance with the magnitude of pressure pulsation.

For example, the bleed valve controlling part 300 controls the opening area of the bleed valve 177 in accordance with the magnitude of pulsation in the pressure of hydraulic oil discharged by the main pump 14. The bleed valve controlling part 300 may also control the opening area of the bleed valve 177 in accordance with the magnitude of pulsation in the pressure of hydraulic oil in a hydraulic actuator in operation, such as the boom rod pressure, the boom bottom pressure, the arm rod pressure, or the arm bottom pressure. For example, the bleed valve controlling part 300 increases the opening area of the bleed valve 177 as the pulsation increases. This is for controlling the pulsation by increasing the damping of the pulsation by increasing the bleed flow rate (including the standby flow rate in the standby state). The bleed valve controlling part 300 decreases the opening area of the bleed valve 177 as the pulsation decreases. This is for controlling the amount of unnecessarily discarded hydraulic oil by decreasing the bleed flow rate (including the standby flow rate in the standby state).

The bleed valve controlling part 300 may calculate the magnitude of the pulsation based on information on the pulsation obtained by an information obtaining device. The information on the pulsation includes at least one of the boom angle $\alpha$, the arm angle $\beta$, the bucket angle $\gamma$, the boom rod pressure, the boom bottom pressure, the arm rod pressure, the arm bottom pressure, the bucket rod pressure, the bucket bottom pressure, an image captured by the camera S6, the discharge pressure of the main pump 14, the operating pressure of the operating apparatus 26, etc. The information obtaining device includes at least one of the boom angle sensor S1, the arm angle sensor S2, the bucket angle sensor S3, the body tilt sensor S4, the turning angular velocity sensor S5, the camera S6, the boom rod pressure sensor S7R, the boom bottom pressure sensor S7B, the arm rod pressure sensor S8R, the arm bottom pressure sensor S8B, the bucket rod pressure sensor S9R, the bucket bottom pressure sensor S9B, the discharge pressure sensor 28, the operating pressure sensor 29, etc. The bleed valve controlling part 300 may determine the magnitude of the pulsation in multiple levels. In this case, the bleed valve controlling part 300 determines the magnitude of the pulsation in three levels of "large," "medium," and "small" based on the output of the discharge pressure sensor 28, for example. Specifically, it is determined that the magnitude of the pulsation is "large" when the fluctuation range of the pump discharge pressure during a predetermined period of time is more than or equal to a first threshold, it is determined that the magnitude of the pulsation is "medium" when the fluctuation range is less than the first threshold and more than or equal to a second threshold, and it is determined that the magnitude of the pulsation is "small" when the fluctuation range is less than the second threshold.

For example, the bleed valve controlling part 300 increases or decreases the opening area of the bleed valve 177 by outputting a control command commensurate with the magnitude of the pulsation to the proportional valve 31. For example, the bleed valve controlling part 300 increases the opening area of the bleed valve 177 by reducing the secondary pressure of the proportional valve 31 by decreasing an electric current command to the proportional valve 31 as the pulsation increases. This is for controlling the pulsation. Conversely, the bleed valve controlling part 300 decreases the opening area of the bleed valve 177 by increasing the secondary pressure of the proportional valve 31 by increasing an electric current command to the proportional valve 31 as the pulsation decreases. This is for controlling the amount of unnecessarily discarded hydraulic oil.

Furthermore, the bleed valve controlling part 300 changes the NEG control characteristic in accordance with an increase or decrease in the opening area of the bleed valve 177. According to this embodiment, the bleed valve controlling part 300 changes the NEG control characteristic by increasing or decreasing the opening area of the NEG control throttles 18L and 18R in accordance with an increase or decrease in the opening area of the bleed valve 177. This is for preventing an increase or decrease in the bleed flow rate from changing the relationship between the amount of lever operation and the actuator flow rate.

For example, the bleed valve controlling part 300 shifts the NEG control characteristic more toward a high pulsation time NEG control setting as the pulsation becomes larger, and shifts the NEG control characteristic more toward a low pulsation time NEG control setting as the pulsation becomes smaller.

The standby flow rate is higher and a decrease in the discharge quantity relative to an increase in the NEG control pressure is slower according to the high pulsation time NEG control setting than according to the low pulsation time NEG control setting. That is, with the NEG control pressure being the same, the discharge quantity of the main pump 14 is larger according to the high pulsation time NEG control setting than according to the low pulsation time NEG control setting. Furthermore, in the case of achieving the same discharge quantity, the NEG control pressure is higher according to the high pulsation time NEG control setting than according to the low pulsation time NEG control setting. The actuator flow rate, however, is the same irrespective of a difference in the NEG control characteristic with the other conditions including the amount of lever operation being equal. For example, with the other conditions including the amount of boom raising operation being equal, the flow rate of hydraulic oil flowing into the bottom-side oil chamber of the boom cylinder 7 is the same irrespective of a difference in the bleed flow rate and a difference in the NEG control characteristic.

Thus, the bleed valve controlling part 300 calculates the magnitude of the pulsation and outputs a control command commensurate with the magnitude of the pulsation to the proportional valve 31. The proportional valve 31 actuates the bleed valve 177 to increase or decrease the bleed flow rate. According to this configuration, the controller 30 can control the pulsation by increasing the bleed flow rate when the pulsation is large. Furthermore, the controller 30 can control the amount of unnecessarily discarded hydraulic coil by decreasing the bleed flow rate when the pulsation is small.

Furthermore, referring to FIG. 3, the control valves 171, 173, 175L, and 176L, which control the flow of hydraulic oil from the main pump 14L to hydraulic actuators, are connected in parallel to one another between the main pump 14L and the hydraulic oil tank. The control valves 171, 173, 175L, and 176L, however, may alternatively be connected in series between the main pump 14L and the hydraulic oil tank. In this case, whichever valve position the spool of each control valve is switched, the conduit 42L can supply hydraulic oil to an adjacent control valve placed on the downstream side without being interrupted by the spool.

Likewise, the control valves 172, 174, 175R, and 176R that control the flow of hydraulic oil from the main pump 14R to hydraulic actuators are connected in parallel to one another between the main pump 14R and the hydraulic oil tank. The control valves 172, 174, 175R, and 176R, however, may alternatively be connected in series between the main pump 14R and the hydraulic oil tank. In this case, whichever valve position the spool of each control valve is switched, the conduit 42R can supply hydraulic oil to an adjacent control valve placed on the downstream side without being interrupted by the spool.

Figure 4:
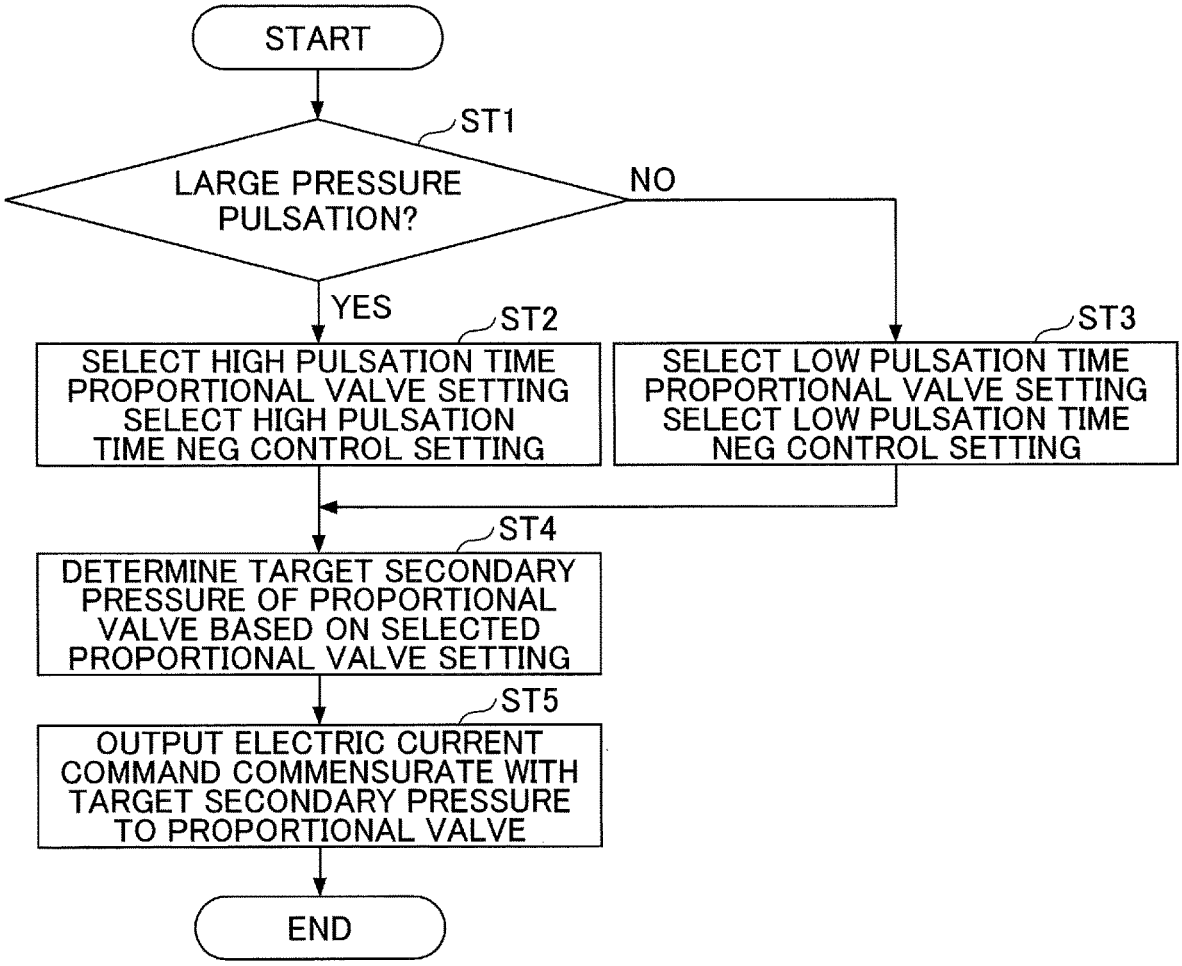
FIG. 4 is a flowchart of an example of a bleed flow rate increasing/decreasing process.
Figure 5:
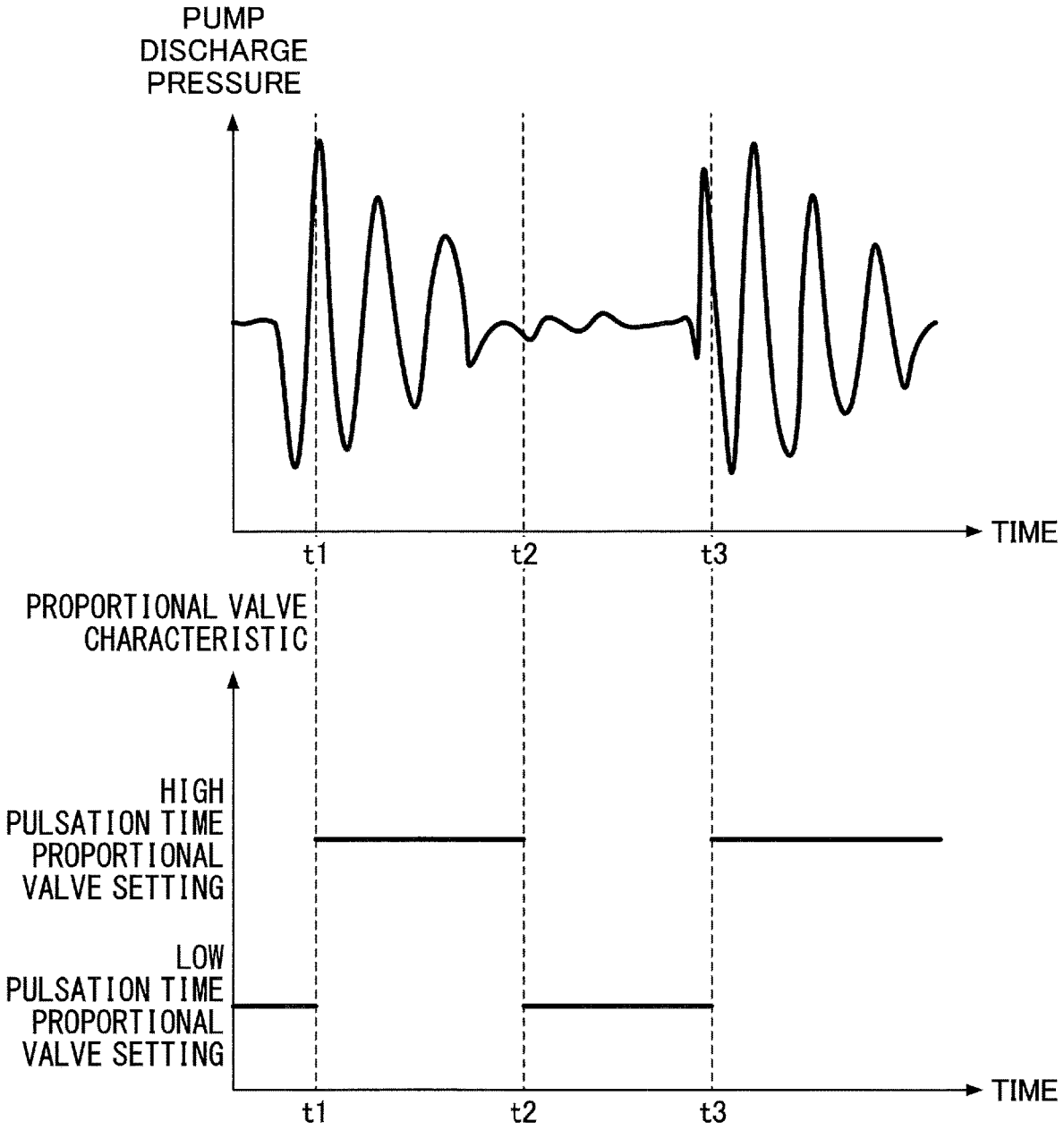
FIG. 5 illustrates a temporal transition of a pump discharge pressure and a proportional valve characteristic during execution of the bleed flow rate increasing/decreasing process during a boom raising operation.

Next, a process of increasing or decreasing the bleed flow rate (hereinafter, "bleed flow rate increasing/decreasing process") by the bleed valve controlling part 300 is described with reference to FIGS. 4 and 5. FIG. 4 illustrates a flowchart of an example of the bleed flow rate increasing/decreasing process. The bleed valve controlling part 300 repeatedly executes this process at predetermined control intervals while the shovel is in operation. FIG. 5 illustrates a temporal transition of the pump discharge pressure and a proportional valve characteristic during execution of the bleed flow rate increasing/decreasing process during the boom raising operation. The proportional valve characteristic means the relationship between the operating pressure of the boom operating lever 26B and the target secondary pressure of the proportional valve 31. For example, like the NEG control characteristic, the proportional valve characteristic may be stored in the ROM or the like as a reference table or may be expressed by a predetermined calculation formula. According to the illustration of FIGS. 4 and 5, the proportional valve characteristic is selected from a high pulsation time proportional valve setting and a low pulsation time proportional valve setting. With the operating pressure of the boom operating lever 26B being the same, the target secondary pressure of the proportional valve 31 is lower according to the high pulsation time proportional valve setting than according to the low pulsation time proportional valve setting. That is, with the operating pressure of the boom operating lever 26B being the same, the opening area of the bleed valve 177 is larger according to the high pulsation time proportional valve setting than according to the low pulsation time proportional valve setting. Furthermore, with the operating pressure of the boom operating lever 26B being the same, the opening area of the NEG control throttle is larger according to the high pulsation time proportional valve setting than according to the low pulsation time proportional valve setting.

First, the bleed valve controlling part 300 determines whether the pressure pulsation of hydraulic oil flowing through the hydraulic circuit is large (step ST1). According to the illustration of FIG. 4, the bleed valve controlling part 300 determines whether the fluctuation range of the discharge pressure of the main pump 14L during a predetermined period of time is greater than a predetermined threshold based on the output of the discharge pressure sensor 28L. In response to determining that the fluctuation range is greater than the predetermined threshold, the bleed valve controlling part 300 determines that the pressure pulsation of hydraulic oil flowing through the conduit 42L is large. The same applies to the pressure pulsation of hydraulic oil flowing through the conduit 42R. The following description, which is about the pressure pulsation of hydraulic oil flowing through the conduit 42L, also applies to the pressure pulsation of hydraulic oil flowing through the conduit 42R.

In response to determining that the pressure pulsation is large (YES at step ST1), the bleed valve controlling part 300 selects the high pulsation time proportional valve setting as the proportional valve characteristic of the proportional valves 31L1 and 31L2 and selects the high pulsation time NEG control setting as the NEG control characteristic (step ST2). According to the illustration of FIG. 5, at each of time t1 and time t3, the bleed valve controlling part 300 determines that the pressure pulsation is large, and selects the high pulsation time proportional valve setting as the proportional valve characteristic of the proportional valves 31L1 and 31L2 and selects the high pulsation time NEG control setting as the NEG control characteristic.

In response to determining that the pressure pulsation is not large (NO at step ST1), the bleed valve controlling part 300 selects the low pulsation time proportional valve setting as the proportional valve characteristic of the proportional valves 31L1 and 31L2 and selects the low pulsation time NEG control setting as the NEG control characteristic (step ST3). According to the illustration of FIG. 5, at time t2, the bleed valve controlling part 300 determines that the pressure pulsation is not large, and selects the low pulsation time proportional valve setting as the proportional valve characteristic of the proportional valves 31L1 and 31L2 and selects the low pulsation time NEG control setting as the NEG control characteristic.

Thereafter, the bleed valve controlling part 300 determines the target secondary pressure of the proportional valves 31L1 and 31L2 based on the selected proportional valve setting (step ST4). According to the illustration of FIG. 4, the bleed valve controlling part 300 refers to a table associated with the proportional valve setting, and determines the target secondary pressure according to the operating pressure output by the operating pressure sensor 29B. That is, the target secondary pressure differs depending on the then condition of the shovel including the magnitude of the pulsation, operation details, etc. Furthermore, the opening area of each of the bleed valve 177L and the NEG control throttle 18L is uniquely determined according to the secondary pressure.

Thereafter, the bleed valve controlling part 300 outputs an electric current command commensurate with the target secondary pressure to the proportional valves 31L1 and 31L2 (step ST5). For example, in response to receiving an electric current command commensurate with the target secondary pressure determined with reference to a table associated with the high pulsation time proportional valve setting, the proportional valves 31L1 and 31L2 reduce a secondary pressure acting on the pilot ports of the bleed valve 177L and the NEG control throttle 18L to the target secondary pressure. Therefore, the opening area of each of the bleed valve 177L and the NEG control throttle 18L increases to increase the bleed flow rate, so that the responsiveness of the NEG control pressure increases and the damping of the pressure pulsation increases. As a result, it is possible to damp the pulsation of the boom bottom pressure during the boom raising operation. The illustration of FIG. 5 shows that the high pulsation time proportional valve setting is selected so that the pressure pulsation of hydraulic oil discharged by the main pump 14, namely, hydraulic oil flowing into the bottom-side oil chamber of the boom cylinder 7, is damped during the period between time t1 and time t2 and the period after time t3. At this point, the bleed valve controlling part 300 refers to the table of the high pulsation time NEG control setting to determine the target discharge quantity of the main pump 14L commensurate with a current NEG control pressure, and outputs a control command commensurate with the target discharge quantity to the regulator 13L. The main pump 14L is so controlled by the regulator 13L as to achieve the target discharge quantity.

Alternatively, for example, in response to receiving an electric current command commensurate with the target secondary pressure determined with reference to a table associated with the low pulsation time proportional valve setting, the proportional valves 31L1 and 31L2 increase a secondary pressure acting on the pilot ports of the bleed valve 177L and the NEG control throttle 18L to the target secondary pressure. Therefore, the opening area of each of the bleed valve 177L and the NEG control throttle 18L decreases to decrease the bleed flow rate. As a result, it is possible to control unnecessary hydraulic energy consumption during the boom raising operation. The illustration of FIG. 5 shows that the low pulsation time proportional valve setting is selected during the period before time t1 and the period between time t2 and time t3. At this point, the bleed valve controlling part 300 refers to the table of the low pulsation time NEG control setting to determine the target discharge quantity of the main pump 14L commensurate with a current NEG control pressure, and outputs a control command commensurate with the target discharge quantity to the regulator 13L. The main pump 14L is so controlled by the regulator 13L as to achieve the target discharge quantity.

According to this configuration, even with the same operating pressure, the bleed valve controlling part 300 can cause the target secondary pressure of the proportional valve 31 to differ between when the pressure pulsation is large and when the pressure pulsation is small. That is, the bleed valve controlling part 300 can cause the bleed flow rate to differ between when the pressure pulsation is large and when the pressure pulsation is small. Therefore, when the pressure pulsation is large, it is possible to damp the pressure pulsation by increasing the bleed flow rate, and when the pressure pulsation is small, it is possible to control unnecessary hydraulic energy consumption by reducing the bleed flow rate.

According to the example illustrated in FIGS. 4 and 5, the bleed valve controlling part 300 determines whether the pressure pulsation is large based on the detected value of the discharge pressure sensors 28L and 28R that detect the discharge pressure of the main pump 14L and 14R. The bleed valve controlling part 300, however, may alternatively determine whether the pressure pulsation is large based on the detected value of a pressure sensor that detects the pressure of hydraulic oil in the hydraulic circuit, such as the boom rod pressure sensor S7R, the boom bottom pressure sensor S7B, the arm rod pressure sensor S8R, the arm bottom pressure sensor S8B, the bucket rod pressure sensor S9R, or the bucket bottom pressure sensor S9B.

Figure 6:
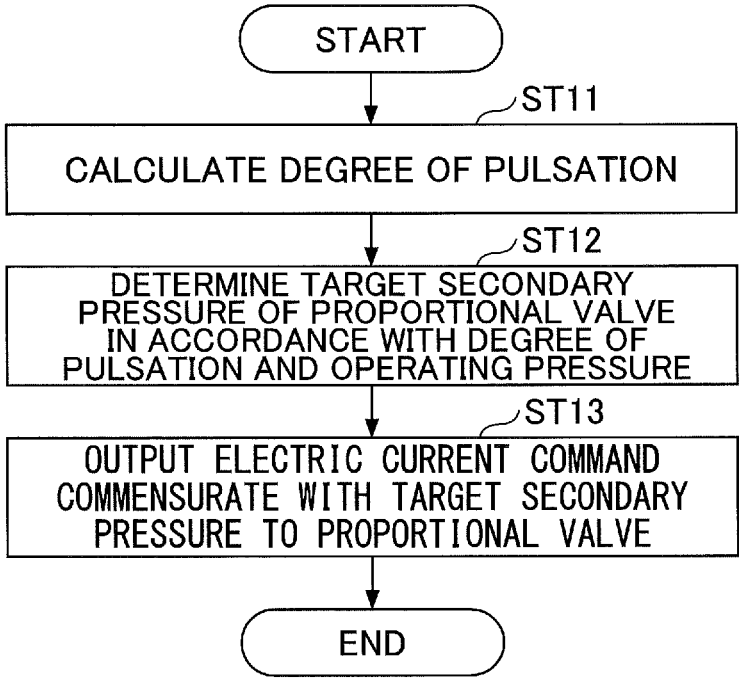
FIG. 6 is a flowchart of another example of the bleed flow rate increasing/decreasing process.

Next, another example of the bleed flow rate increasing/decreasing process is described with reference to FIG. 6. FIG. 6 is a flowchart of another example of the bleed flow rate increasing/decreasing process. The bleed valve controlling part 300 repeatedly executes this process at predetermined control intervals while the shovel is in operation.

First, the bleed valve controlling part 300 calculates the magnitude of the pressure pulsation of hydraulic oil flowing through the hydraulic circuit as the degree of pulsation (step ST11). According to the illustration of FIG. 6, the bleed valve controlling part 300 calculates the fluctuation range of the discharge pressure of the main pump 14L during a predetermined period of time as the degree of pulsation that represents the magnitude of the pressure pulsation of hydraulic oil flowing through the conduit 42L, based on the output of the discharge pressure sensor 28L. The same applies to the pressure pulsation of hydraulic oil flowing through the conduit 42R. The following description, which is about the pressure pulsation of hydraulic oil flowing through the conduit 42L, also applies to the pressure pulsation of hydraulic oil flowing through the conduit 42R.

Thereafter, the bleed valve controlling part 300 determines the target secondary pressure of the proportional valves 31L1 and 31L2 in accordance with the degree of pulsation and the operating pressure (step ST12). According to the illustration of FIG. 6, the bleed valve controlling part 300 determines the target secondary pressure according to the calculated degree of pulsation and the operating pressure output by the operating pressure sensor 29B.

Thereafter, the bleed valve controlling part 300 outputs an electric current command commensurate with the target secondary pressure to the proportional valves 31L1 and 31L2 (step ST13). The proportional valves 31L1 and 31L2 adjust a secondary pressure acting on the pilot ports of the bleed valve 177L and the NEG control throttle 18L to the target secondary pressure. Therefore, when the opening area of each of the bleed valve 177L and the NEG control throttle 18L is increased, it is possible to increase the responsiveness of the NEG control pressure and to increase the damping of the pressure pulsation. As a result, it is possible to damp the pulsation of the boom bottom pressure during the boom raising operation. When the opening area of each of the bleed valve 177L and the NEG control throttle 18L is reduced, it is possible to control unnecessary hydraulic energy consumption.

According to this configuration, the bleed valve controlling part 300 can steplessly (seamlessly) determine the target secondary pressure of the proportional valves 31L1 and 31L2 in accordance with the magnitude of the pressure pulsation. Therefore, it is possible to damp the pressure pulsation by increasing the bleed flow rate as the pressure pulsation increases, and it is possible to control unnecessary hydraulic energy consumption by decreasing the bleed flow rate as the pressure pulsation decreases.

As described above, the shovel according to an embodiment of the present invention includes the bleed valve 177 that controls the bleed flow rate and the controller 30 that controls the opening area of the bleed valve 177 in accordance with the magnitude of the pulsation of the pressure of hydraulic oil discharged by the main pump 14. Therefore, when the pulsation is large, it is possible to increase the damping of the pressure pulsation by increasing the bleed flow rate by increasing the opening area of the bleed valve 177. As a result, it is possible to control the pulsation of the pressure of hydraulic oil flowing through the hydraulic circuit. Furthermore, when the pulsation is small, it is possible to control unnecessary hydraulic energy consumption by decreasing the bleed flow rate by decreasing the opening area of the bleed valve 177.

An embodiment of the present invention is described in detail above. The present invention, however, is not limited to the above-described embodiment. Variations, replacements, etc., may be applied to the above-described embodiment without departing from the scope of the present invention. Furthermore, separately described features may be combined as long as no technical contradiction arises.

Figure 7:
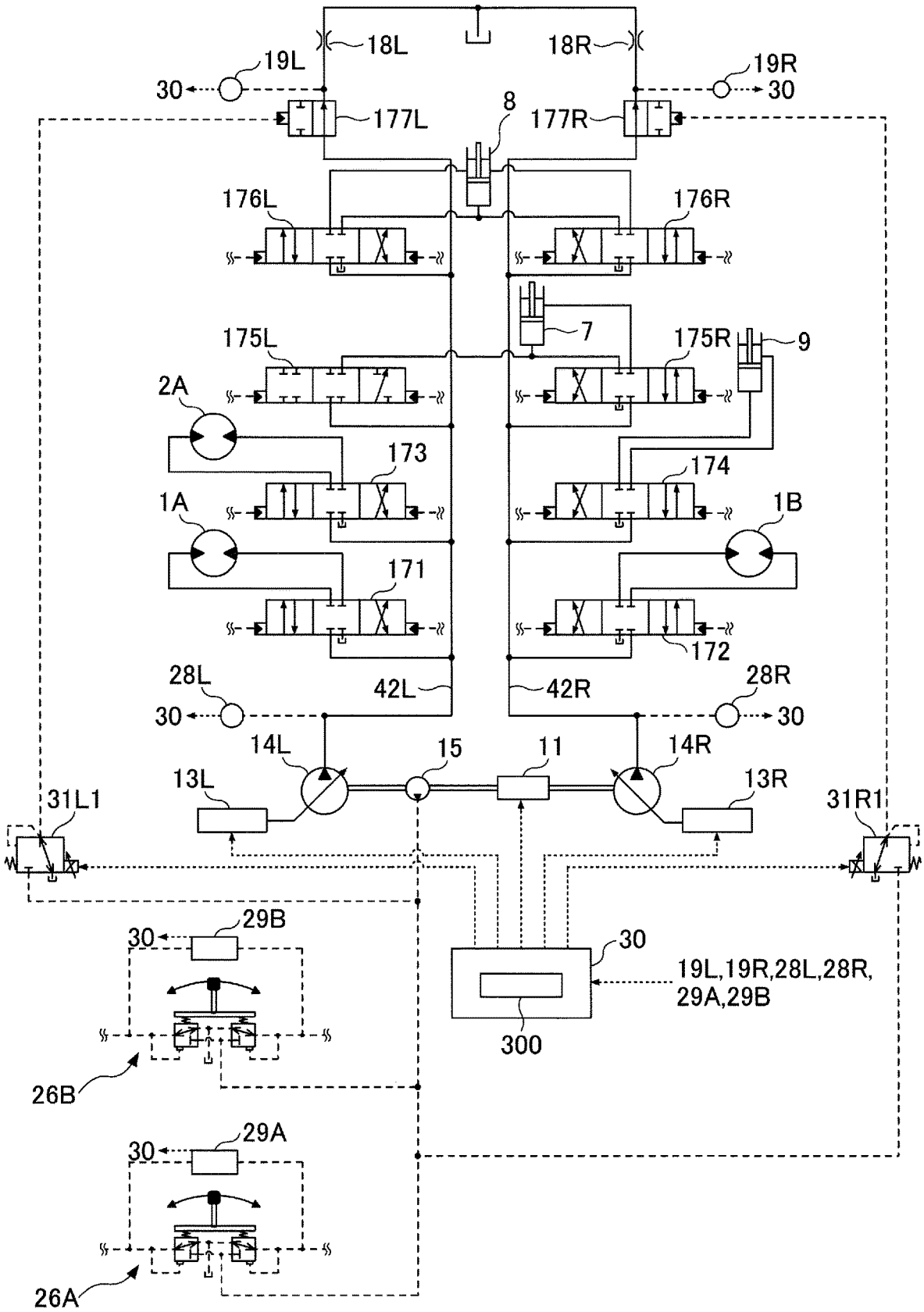
FIG. 7 is a schematic diagram illustrating another example configuration of the hydraulic circuit installed in the shovel of FIG. 1.

For example, according to the above-described embodiment, the NEG control throttles 18L and 18R are variable throttles whose opening area changes in accordance with the secondary pressure of the proportional valves 31L1 and 31L2. Furthermore, the NEG control throttles 18L and 18R are so configured as to decrease the opening area as the secondary pressure of the proportional valves 31L1 and 31L2 increases, for example. The NEG control throttles 18L and 18R, however, may alternatively be fixed throttles as illustrated in FIG. 7. In this case, the proportional valves 31L2 and 31R2 may be omitted.

According to the illustration of FIG. 7, when the opening area of the bleed valves 177L and 177R increases to increase the bleed flow rate reaching the NEG control throttles 18L and 18R, the NEG control pressure generated by the NEG control throttles 18L and 18R, which are fixed throttles, increases. Therefore, the bleed valve controlling part 300 changes the NEG control characteristic by adjusting the movement of the regulators 13L and 13R, that is, adjusting the swash plate tilt angle of the main pumps 14L and 14R, instead of increasing or decreasing the opening area of the NEG control throttles 18L and 18R, in accordance with an increase or decrease in the opening area of the bleed valve 177. This is for preventing an increase or decrease in the bleed flow rate from changing the relationship between the amount of lever operation and the actuator flow rate.

According to this configuration, a shovel including the hydraulic circuit illustrated in FIG. 7 can achieve the same effects as achieved by a shovel including the hydraulic circuit illustrated in FIG. 3.

Furthermore, according to the above-described embodiment, the control valves 171, 173, 175L, and 176L that control the flow of hydraulic oil from the main pump 14L to hydraulic actuators are connected in parallel to one another between the main pump 14L and the hydraulic oil tank through the conduit 42L. The control valves 171, 173, 175L, and 176L, however, may alternatively be connected in series between the main pump 14L and the hydraulic oil tank. For example, the control valves 171, 173, 175L, and 176L may be connected in series through a first center bypass conduit. In this case, whichever valve position the spools of the control valves are switched, hydraulic oil flowing through the first center bypass conduit is not interrupted by any spools. Therefore, whichever valve position the spool of each control valve is switched, hydraulic oil flowing through the first center bypass conduit can reach an adjacent control valve placed on the downstream side.

Likewise, the control valves 172, 174, 175R, and 176R may alternatively be connected in series between the main pump 14R and the hydraulic oil tank. For example, the control valves 172, 174, 175R, and 176R may be connected in series through a second center bypass conduit. In this case, whichever valve position the spools of the control valves are switched, hydraulic oil flowing through the second center bypass conduit is not interrupted by any spools. Therefore, whichever valve position the spool of each control valve is switched, hydraulic oil flowing through the second center bypass conduit can reach an adjacent control valve placed on the downstream side.

According to this configuration, a shovel including the above-described hydraulic circuit can achieve the same effects as achieved by shovels including the hydraulic circuits illustrated in FIGS. 3 and 7.

What is claimed is:

1. A shovel comprising:

a lower traveling body;

an upper turning body turnably mounted on the lower traveling body;

a hydraulic pump mounted on the upper turning body;

a hydraulic actuator configured to be driven with hydraulic oil discharged by the hydraulic pump;

a bleed valve configured to control a flow rate of a portion of the hydraulic oil discharged by the hydraulic pump, the portion flowing to a hydraulic oil tank without going through the hydraulic actuator;

an information obtaining device configured to obtain information on pulsation with respect to the hydraulic actuator; and a control device configured to calculate a magnitude of the pulsation based on the information obtained by the information obtaining device and control an opening area of the bleed valve in accordance with the calculated magnitude of the pulsation.

2. The shovel as claimed in claim 1, wherein the control device is configured to decrease the opening area of the bleed valve as the pulsation decreases.

3. The shovel as claimed in claim 1, further comprising:

a plurality of control valves configured to control a flow of hydraulic oil from the hydraulic pump to the hydraulic actuator, the plurality of control valves being connected in parallel to each other between the hydraulic pump and the hydraulic oil tank.

4. The shovel as claimed in claim 1, further comprising:

a pressure sensor configured to detect a pressure of the hydraulic oil discharged by the hydraulic pump, wherein the control device is configured to detect the magnitude of the pulsation in the pressure of the hydraulic oil based on a detected value of the pressure sensor.

5. The shovel as claimed in claim 1, further comprising:

a pressure sensor configured to detect a pressure of hydraulic oil in the hydraulic actuator, wherein the control device is configured to detect the magnitude of the pulsation in the pressure of the hydraulic oil based on a detected value of the pressure sensor.

6. The shovel as claimed in claim 1, wherein the control device is configured to determine the magnitude of the pulsation in multiple levels.

7. The shovel as claimed in claim 1, wherein the control device is configured to change a relationship between a control pressure for controlling a regulator and a discharge quantity of the hydraulic pump in accordance with an increase or decrease in the opening area.

8. The shovel as claimed in claim 1, further comprising:

a fixed throttle placed downstream of the bleed valve.

9. The shovel as claimed in claim 1, further comprising:

a control valve configured to control hydraulic oil to the hydraulic actuator, wherein a change in a position of a spool of the control valve is prevented from causing the spool to disconnect the hydraulic pump and the hydraulic oil tank.

10. The shovel as claimed in claim 1, wherein the pulsation is a fluctuation range of the pressure of the hydraulic oil.

11. The shovel as claimed in claim 1, wherein a relationship between an amount of lever operation and a flow rate of hydraulic oil flowing to the hydraulic actuator remains unchanged irrespective of a change in the opening area.

12. The shovel as claimed in claim 1, wherein the information obtaining device is provided in or on at least one of a hydraulic circuit, an attachment, the hydraulic actuator, and the upper turning body of the shovel.

13. A shovel comprising:

a lower traveling body;

an upper turning body turnably mounted on the lower traveling body;

a hydraulic pump mounted on the upper turning body;

a hydraulic actuator configured to be driven with hydraulic oil discharged by the hydraulic pump;

a throttle configured to control a flow rate of a portion of the hydraulic oil discharged by the hydraulic pump, the portion flowing to a hydraulic oil tank without going through the hydraulic actuator;

an information obtaining device configured to obtain information on pulsation with respect to the hydraulic actuator; and a control device configured to calculate a magnitude of the pulsation based on the information obtained by the information obtaining device and control an opening area of the throttle in accordance with the calculated magnitude of the pulsation.

14. The shovel as claimed in claim 13, wherein the control device is configured to decrease the opening area of the throttle as the pulsation decreases.

15. The shovel as claimed in claim 13, further comprising:

a plurality of control valves configured to control a flow of hydraulic oil from the hydraulic pump to the hydraulic actuator, the plurality of control valves being connected in parallel to each other between the hydraulic pump and the hydraulic oil tank.

16. The shovel as claimed in claim 13, further comprising:

a pressure sensor configured to detect a pressure of the hydraulic oil discharged by the hydraulic pump, wherein the control device is configured to detect the magnitude of the pulsation in the pressure of the hydraulic oil based on a detected value of the pressure sensor.

17. The shovel as claimed in claim 13, further comprising:

a pressure sensor configured to detect a pressure of hydraulic oil in the hydraulic actuator, wherein the control device is configured to detect the magnitude of the pulsation in the pressure of the hydraulic oil based on a detected value of the pressure sensor.

18. The shovel as claimed in claim 13, wherein the control device is configured to determine the magnitude of the pulsation in multiple levels.

19. The shovel as claimed in claim 13, wherein the control device is configured to change a relationship between a control pressure for controlling a regulator and a discharge quantity of the hydraulic pump in accordance with an increase or decrease in the opening area.

20. The shovel as claimed in claim 13, further comprising:

a control valve configured to control hydraulic oil to the hydraulic actuator, wherein a change in a position of a spool of the control valve is prevented from causing the spool to disconnect the hydraulic pump and the hydraulic oil tank.

21. The shovel as claimed in claim 13, wherein a relationship between an amount of lever operation and a flow rate of hydraulic oil flowing to the hydraulic actuator remains unchanged irrespective of a change in the opening area.

22. The shovel as claimed in claim 13, wherein the information obtaining device is provided in or on at least one of a hydraulic circuit, an attachment, the hydraulic actuator, and the upper turning body of the shovel.

* * * * *